United States Patent [19]

Fricker

[11] 4,433,516

[45] Feb. 28, 1984

[54] WALL PANEL ALIGNMENT SYSTEM

[76] Inventor: Siegfried Fricker,
Wurmbergerstrasse 30-34, 7135
Wiernsheim, Fed. Rep. of Germany

[21] Appl. No.: 298,723

[22] Filed: Sep. 2, 1981

[30] Foreign Application Priority Data

Sep. 2, 1980 [DE] Fed. Rep. of Germany ..... 3032930

[51] Int. Cl.[3] ..... E04D 15/00

[52] U.S. Cl. ..... 52/126.3; 52/235; 52/587

[58] Field of Search ..... 52/126.1, 126.3, 126.4, 52/126.5, 126.7, 235, 513, 587

[56] References Cited

U.S. PATENT DOCUMENTS 3,110,131 11/1963 Jeffress ..... 52/235 X
3,640,043 2/1972 Querfeld et al. ..... 52/235 X

FOREIGN PATENT DOCUMENTS 2219185 10/1973 Fed. Rep. of Germany .
2412661 10/1974 Fed. Rep. of Germany ..... 52/235

*Primary Examiner*—Carl D. Friedman
*Attorney, Agent, or Firm*—Joseph A. Geiger

[57] ABSTRACT

A system for the surface alignment of two vertically adjacent prefabricated wall panels on a building face, using alignment fittings which permit panel displacements in the alignment plane, the fittings including an alignment stake extending from the end face of one wall panel into a mortise recess in the end face of the other wall panel and carrying within that recess a transversely adjustable threaded alignment pin. This pin fits between two parallel walls of the mortise recess which are defined by two embedded mortise plates.

5 Claims, 3 Drawing Figures

WALL PANEL ALIGNMENT SYSTEM

BACKGROUND OF THE INVENTION

1. Field of the Invention

The present invention relates to systems and fittings for the assembly of prefabricated building components and, more particularly, to a system for the surface alignment of prefabricated concrete wall panels which are suspended on the outer face of a building.

2. Description of the Prior Art

For the aesthetic appearance of a building, it is important that its outer wall elements be mounted with accurately aligned surfaces. In the case of prefabricated wall panels, each panel is suspended separately. Because of variations in the supporting structure, it is necessary to provide surface alignment means which may take the form of an alignment member extending from one wall panel into a matching cavity of the other wall panel. The alignment member is adjustable perpendicularly to the alignment plane, but free to move in that plane, thereby producing an alignment interaction without transmitting any loadbearing forces between vertically adjacent wall panels.

Such a wall panel alignment system is disclosed in the German Patent No. 22 19 185 which suggests the use of a vertical alignment pin which has a threaded upper portion rotatably engaged in a plastic socket of the upper wall panel and an eccentrically offset lower portion engaging an oblong opening in a mortise frame which is permanently anchored in the upper face of the lower wall panel. A counter-nut secures the rotational position of the adjustment pin in relation to the socket which is embedded in the lower face of the upper wall panel. By releasing the counter-nut and rotating the eccentric alignment pin, it is possible to transversely reposition the two wall panels in relation to each other within the range of eccentricity of the alignment pin.

One shortcoming of this prior art system is that it requires comparatively expensive fittings, including a threaded socket, a machined eccentric alignment pin and a welded mortise frame. Another shortcoming of this configuration is related to the risk of the counter-nut becoming loose at the plastic socket, under the application of lateral forces to the wall panels, with the result that the alignment pin may rotate and the surfaces of the two wall panels may move out of alignment.

SUMMARY OF THE INVENTION

Underlying the present invention is the primary objective of providing an improved wall panel alignment system which, while eliminating the shortcomings of the prior art solution, offers a secure alignment between vertically adjacent wall panels with low-cost fittings which are easy to install and adjust.

The present invention proposes to attain this objective by suggesting a wall panel alignment system which comprises a vertical alignment stake embedded in the upper face of the lower wall panel, a pair of mortise plates embedded in the lower face of the upper wall panel, and an alignment pin engaged between the mortise plates with minimal axial clearance and adjustably attached to the upper end portion of the alignment stake.

In a preferred embodiment of the invention, the alignment pin is a threaded pin or set screw engaging a threaded bore of the alignment stake. The threaded pin has an appropriate tool socket for rotation to the correct adjustment position.

The two mortise plates form a rectangular cavity in the upper wall panel, and the length of the threaded pin is such that it fits between the side walls of the mortise cavity. The result is a direct rigid engagement between the alignment fittings of the two wall panels and an adjustment configuration which is free of the risk of accidental loss of the adjustment setting.

The extremities of the alignment pin are the only points of contact between the upper and lower wall panels, and the latter are therefore free to execute vertical as well as lateral relative displacements in the alignment plane during the installation process and/or as a result of thermal expansion and contraction of the wall panels.

The fittings for the proposed wall panel alignment system are preferably stainless steel fittings to prevent the possibility of corrosive deterioration. As an alternative to the threaded pin, it is also possible to utilize a smooth pin in conjunction with appropriate pin clamping means, such as a transversely oriented set screw, for example.

BRIEF DESCRIPTION OF THE DRAWINGS

Further special features and advantages of the invention will become apparent from the description following below, when taken together with the accompanying drawing, which illustrates, by way of example, a preferred embodiment of the invention which is represented in the various figures as follows:

FIG. 3 is similar to FIG. 2, showing a modified embodiment of the invention.

DESCRIPTION OF THE PREFERRED EMBODIMENT

Figure 1:
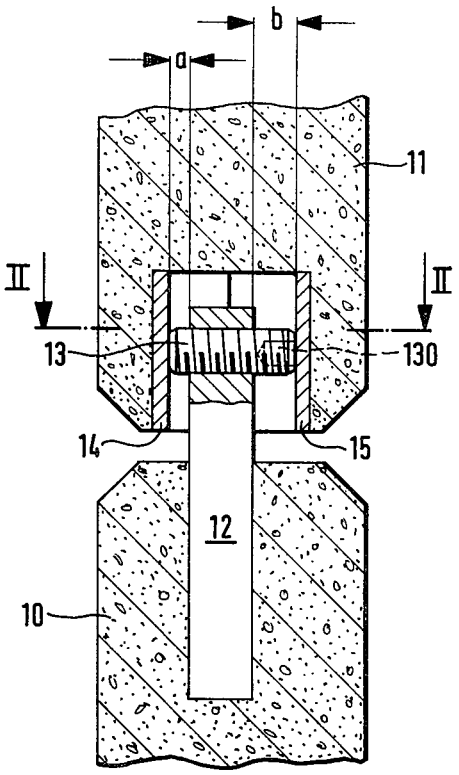
FIG. 1 shows, in a vertical cross section, portions of vertically adjacent wall panels with alignment fittings representing an embodiment of the present invention.
Figure 2:
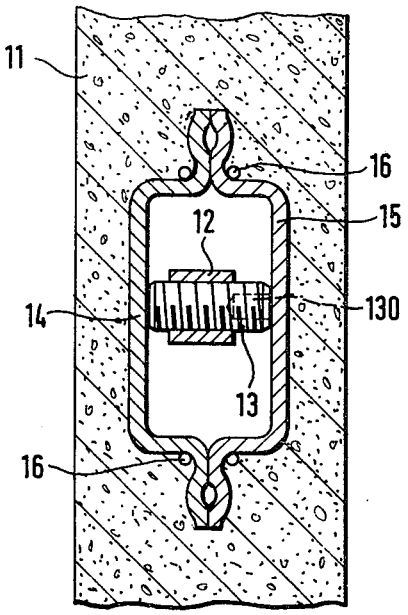
FIG. 2 is a horizontal cross section through the upper wall panel, taken at line II—II of FIG. 1.

As can be seen in the drawing, the wall panel alignment system of the invention consists essentially of an alignment stake 12 which is permanently embedded in the lower wall panel 10, a pair of mortise plates 14 and 15 embedded in the lower end face of the upper wall panel 11, and an alignment member in the form of a threaded pin 13 in the upper end portion of the alignment stake 12.

The alignment stake 12 is a length of square rod which protrudes a distance from the upper end face of the lower wall panel 10, reaching into a prismatic recess formed by the two mortise plates 14 and 15. The latter are so arranged in the upper wall panel 11 that their lower edges are flush with the lower end face of the panel. The mortise plates 14 and 15 are secured by anchoring rods 16.

The two mortise plates 14 and 15 form two spaced walls which are parallel to each other and to the alignment plane of the wall panels. The length of the threaded pin 13 corresponds to the width of the mortise recess, as measured between its two walls, so that, while the pin 13 is movable vertically and laterally within the mortise recess, it is confined in the transverse sense by contact between its axial extremities and the mortise plates 14 and 15. This means that only forces perpendicular to the two walls of the mortise plates 14 and 15 are transmittable to the alignment pin 13 and, via the alignment stake 12, to the lower wall panel 10.

The purpose of the wall panel alignment system of the invention is not only to maintain a rigid alignment connection between the upper and lower wall panels, but also to compensate for deviations in the embedded positions of the alignment stake 12 in the lower wall panel 10 and of the mortise frame 14, 15 in the upper wall panels 10. Such a deviation of the embedded position of the alignment fittings is shown in FIG. 1, where the alignment stake 12 is shown to reach into the mortise cavity with unequal distances a and b to the recess walls of the mortise plates 14 and 15. Compensating for this deviation is the threaded pin 13 which is simply screwed forward or backward until its two extremities are in alignment with the cavity walls, prior to insertion of the alignment stake 12 into the mortise recess. For this purpose, the alignment pin 13 has an appropriate tool socket 130 which may be a hex socket or a screw driver slot, for example.

The correct setting of the alignment pin 13 is obtained by measuring the thickness between the front face of the upper wall panel 11 and the inside face of the proximate wall of the mortise recess and by adjusting the alignment pin 13 until the distance between its forward extremity and the outer surface of the lower wall panel 10 matches that thickness.

The proposed wall panel alignment system is free of maintenance problems, its fittings being preferably of stainless steel to preclude corrosive aging. The alignment setting, once established, remains unchanged. Meanwhile, the wall panels are free to execute relative displacements in the alignment plane, under thermal expansion and contraction, for example.

By way of alternatives to the preferred embodiment of the invention, as shown and described above, it is, of course, also possible to substitute equivalent elements of different shape. Thus, it is possible to replace the square rod of the alignment stake 12 with a length of threaded rod which is, at the time of assembly, screwed into an appropriately threaded, permanently embedded anchoring sleeve of the lower wall panel. The major advantage of such a two-part alignment stake is that its protruding part is not permanently attached to the wall panel 10, thereby simplifying the handling and transportation of the wall panels.

As can be seen in FIG. 3, it is also possible to substitute for the threaded alignment pin 13 a smooth pin 17 which is received in a smooth bore of the alignment stake 12' and secured by a clamping bolt 18. Other pin clamping means may be of the set-screw-type, or of the split-bore-type having a slot or two separate clamping legs which, under the action of a threaded fastener, shift the bore portions into a clamping position.

Accordingly, it should be understood that the foregoing disclosure describes only a preferred embodiment of the invention and that it is intended to cover all changes and modifications of this example of the invention which fall within the scope of the appended claims.

I claim the following:

1. A system for the alignment of the surfaces of two adjacent wall panels in a common plane, with freedom for relative displacement of the panels in said alignment plane, the system being particularly suited for use in conjunction with concrete wall panels which are mounted on the face of a building, the wall panel alignment system comprising in combination:

an alignment mortise in the end face of a first one of the two wall panels, the mortise being in the form of a recess, having two opposing longitudinal walls which are parallel to the alignment plane;

an alignment stake which is fixedly attached to the second wall panel, having an end portion extending a distance into the mortise recess in such a way that it is surrounded by the latter without touching its walls; and an alignment member which is attached to the mortise-surrounded end portion of the alignment stake, in an orientation which is transverse to the parallel walls of the mortise recess; and wherein the alignment member fits between the parallel walls of the mortise recess with minimal displacement clearance at two opposing contact points; and the alignment member is attached to the alignment stake in such a way that the portion of its contact points with the walls of the mortise recess in relation to the alignment stake is adjustable in a direction which is transverse to the alignment plane.

2. A wall panel alignment system as defined in claim 1, wherein the alignment stake is an elongated member of which a length portion is permanently embedded in the material of the second wall panel.

3. A wall panel alignment system as defined in claim 1, wherein the alignment mortise is formed by two mortise plates;

the mortise plates have central portions which form the parallel walls of the mortise recess; and the mortise plates are permanently embedded in the material of the first wall panel.

4. A wall panel alignment system as defined in any one of claims 1 through 3, wherein the alignment member is a threaded pin, its contact points being on its axial extremities; and the alignment stake has in its recess-surrounded end portion a matching threaded bore which is oriented transversely to the parallel walls of the mortise recess.

5. A wall panel alignment system as defined in any one of claims 1 through 3, wherein the alignment member is a cylindrical pin, its contact points being on its axial extremities; and the alignment stake includes a transverse bore receiving the pin and means for adjustably clamping the pin in the transverse bore.

* * * * *